US009907392B1

(12) United States Patent
Apostolovski

(10) Patent No.: US 9,907,392 B1
(45) Date of Patent: Mar. 6, 2018

(54) PAINT BRUSH WITH BUILT-IN PAINT CAN OPENER AND SEALER

(71) Applicant: Dragan Apostolovski, Linden, NJ (US)

(72) Inventor: Dragan Apostolovski, Linden, NJ (US)

( * ) Notice: Subject to any disclaimer, the term of this patent is extended or adjusted under 35 U.S.C. 154(b) by 0 days.

(21) Appl. No.: 15/378,228

(22) Filed: Dec. 14, 2016

(51) Int. Cl.

| | |
|---|---|
| ***A46B 15/00*** | (2006.01) |
| ***B25F 1/00*** | (2006.01) |
| ***B67B 7/14*** | (2006.01) |
| ***B67B 7/44*** | (2006.01) |
| ***B67B 7/00*** | (2006.01) |

(52) U.S. Cl.
CPC ..... *A46B 15/0063* (2013.01); *B25F 1/00* (2013.01); *B67B 7/00* (2013.01); *B67B 7/14* (2013.01); *B67B 7/44* (2013.01); *A46B 2200/202* (2013.01)

(58) Field of Classification Search
CPC ..... A46B 5/00; A46B 15/00; A46B 15/0055; A46B 15/0063; A46B 2200/202; B25F 1/00; B67B 7/00; B67B 7/14; B67B 7/16; B67B 7/44
USPC ..... 15/105, 111, 246; 7/105, 151; 81/3.55, 81/3.57; D4/116, 118; D8/33, 34, 40
See application file for complete search history.

(56) References Cited

U.S. PATENT DOCUMENTS

| | | | | |
|---|---|---|---|---|
| 2,603,991 | A | 7/1952 | Oliver | |
| 4,631,769 | A | 12/1986 | White | |
| 4,741,064 | A * | 5/1988 | Riegert | A47L 13/08 15/111 |
| 4,757,568 | A | 7/1988 | Jones | |
| D301,196 | S | 5/1989 | Price | |
| 5,575,030 | A | 11/1996 | Girard | |
| 6,360,444 | B1 | 3/2002 | Fluhr et al. | |
| 6,823,553 | B1 | 11/2004 | Daredes | |
| 9,402,464 | B2 | 8/2016 | Beermeunder et al. | |
| 2004/0163193 | A1 | 8/2004 | Stafford | |
| 2014/0338500 | A1 * | 11/2014 | Cridlebaugh | B67B 7/12 81/3.27 |

* cited by examiner

*Primary Examiner* — Mark Spisich
(74) *Attorney, Agent, or Firm* — Thomas J. Germinario

(57) ABSTRACT

A tool, consisting of a flanged lever arm fabricated from a strip of rigid metal, is recessed in a channel located in the distal end of a paint brush handle, along one of the handle's lateral edges. The proximal end of the tool terminates in a flange, which is configured to be inserted under the lid bead of a paint can. Using the container bead as a fulcrum, the handle is leveraged upward so that the flange engages the lid bead and lifts it away from the container channel. To re-seal the lid, the handle is leveraged downward, so that the lever arm bears down on the lid channel and forces it into the container channel.

8 Claims, 4 Drawing Sheets

PAINT BRUSH WITH BUILT-IN PAINT CAN OPENER AND SEALER

FIELD OF INVENTION

The present invention relates to the fields of paint brushes and tools for prying and/or sealing the lids of paint cans, and more particularly to paint brushes which incorporate tools for prying and sealing the lids of paint cans.

BACKGROUND OF THE INVENTION

A typical paint can 100, as depicted in cross-section in FIG. 1, has a container surface 101 terminating at its upper end in a container bead 102. Around the periphery of the container's upper surface and inward from the container bead 102 is a container lip 103, which inwardly transitions into a circular container channel 104. The lid 105 has a corresponding lid channel 106, which is configured to fit into the container channel 104 and form a seal. Around the perimeter of the lid 105 is a raised lid bead 107, which is used in prying the lid 105 open.

Typically, the lid 105 is pried open by inserting a screw driver or similar tool into the gap between the container lip 103 and the lid bead 107. The lid 105 is commonly re-sealed by tapping on it with a hammer or the handle end of a screw driver.

This conventional approach to opening and re-sealing a paint can has two disadvantages. First, the painter is compelled to carry an additional tool, such as a screw driver. Second, the hammering on the lid to re-seal it often bends the lid channel 106, preventing it from sealing tightly.

The present invention avoids these disadvantages by providing a lid prying and sealing tool that is built into a paint brush and that employs leverage, rather than hammering, to re-seal the lid.

SUMMARY OF THE INVENTION

The tool of the present invention is a flanged lever arm, fabricated from a strip of rigid metal, set into a recessed channel in one of the lateral edges at the distal end of a paint brush. The proximal end of the tool (i.e., the end closest to the head of the brush) terminates in a flange member, which is configured to be inserted under the lid bead of the paint can.

As shown in FIG. 2, with the lateral edge 202 of the paint brush 201 resting on the container bead 102 as a fulcrum, the brush 201 is leveraged upward 203, so that the flange member 204 engages the lid bead 107 and lifts it away from the container channel 104. By proceeding around the lid 105 in this manner, the lid 105 is progressively pried free from the paint can 100.

Conversely, to re-seal the lid channel 106 into the container channel 104, as depicted in FIG. 2, the brush 201 is leveraged downward 205, again with its lateral edge 202 engaging the container bead 102 as a fulcrum. This downward leverage 205 forces the lever arm 206 at the tool's distal end to bear downward on the lid channel 106, forcing it into the container channel 104 and thereby re-sealing the paint can 100.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
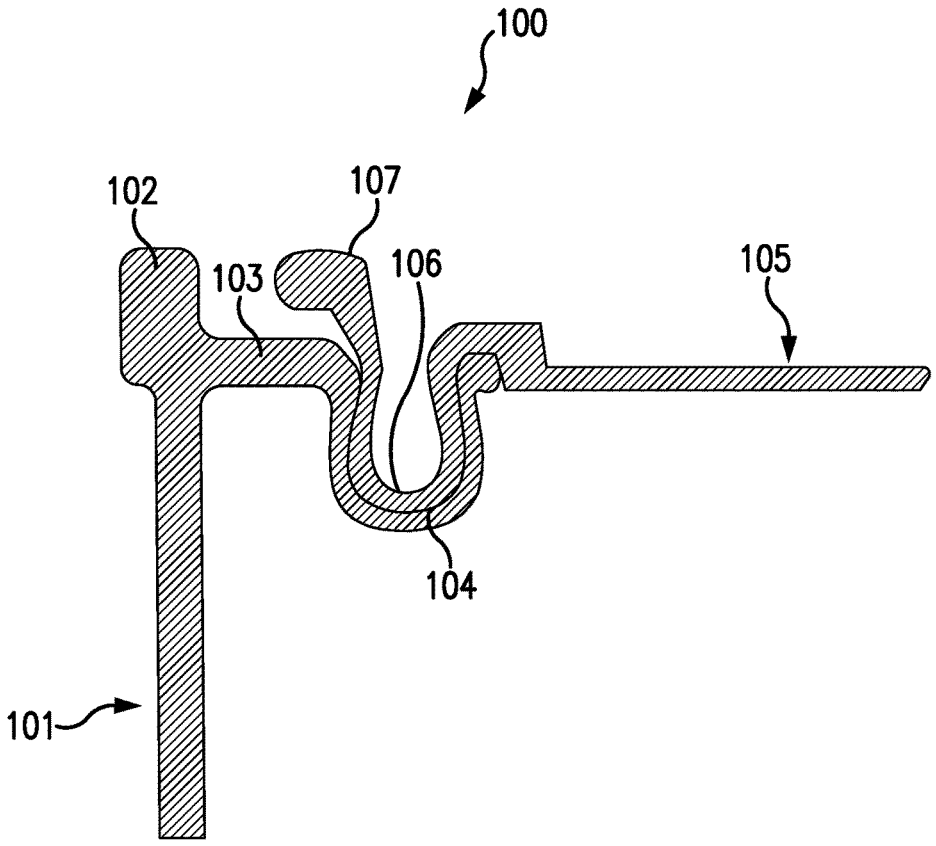
FIG. 1 is a detail cross-section view of an upper portion of a standard paint can.
Figure 2:
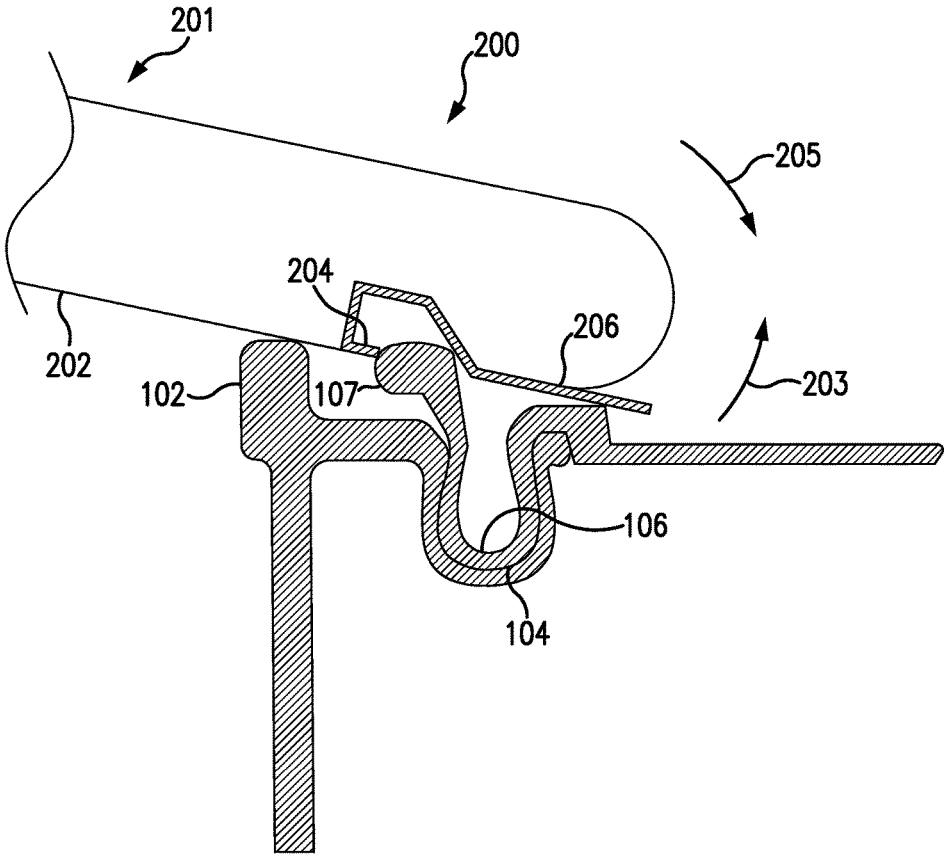
FIG. 2 is the detail cross-section of FIG. 1 with a partial side profile view of one embodiment of the present invention engaged in prying and re-sealing the lid of the paint can.
Figure 3:
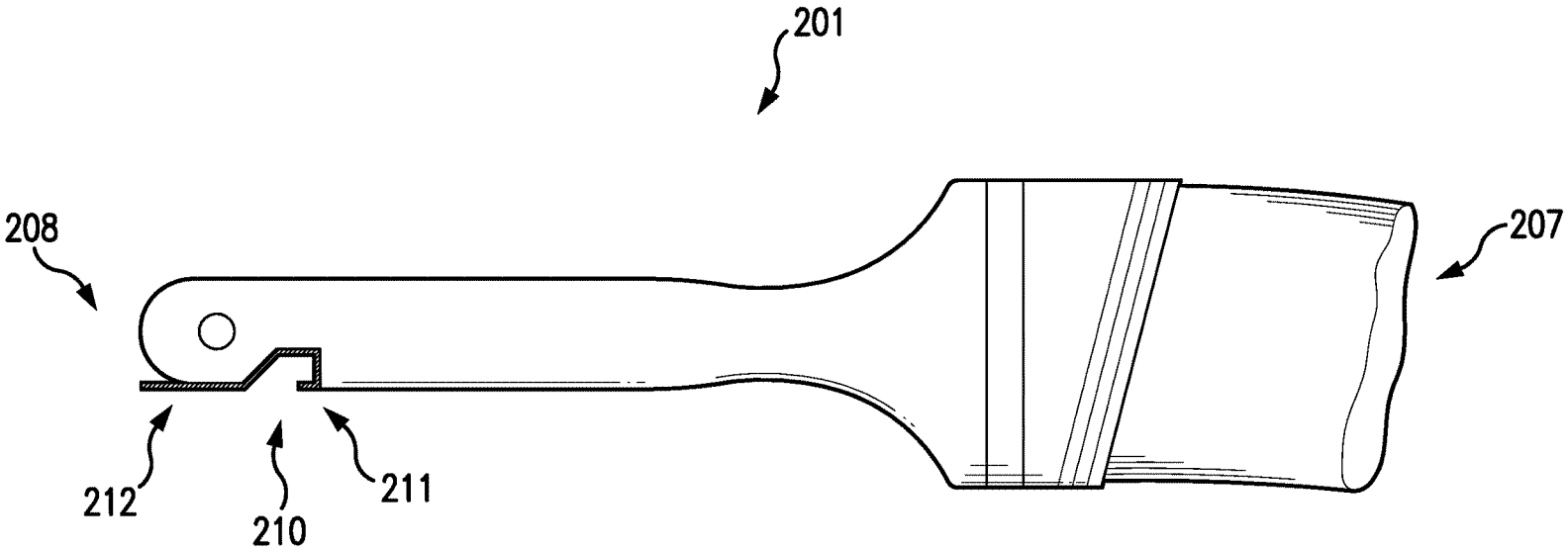
FIG. 3 is a side profile view of one embodiment of the present invention.
Figure 4:
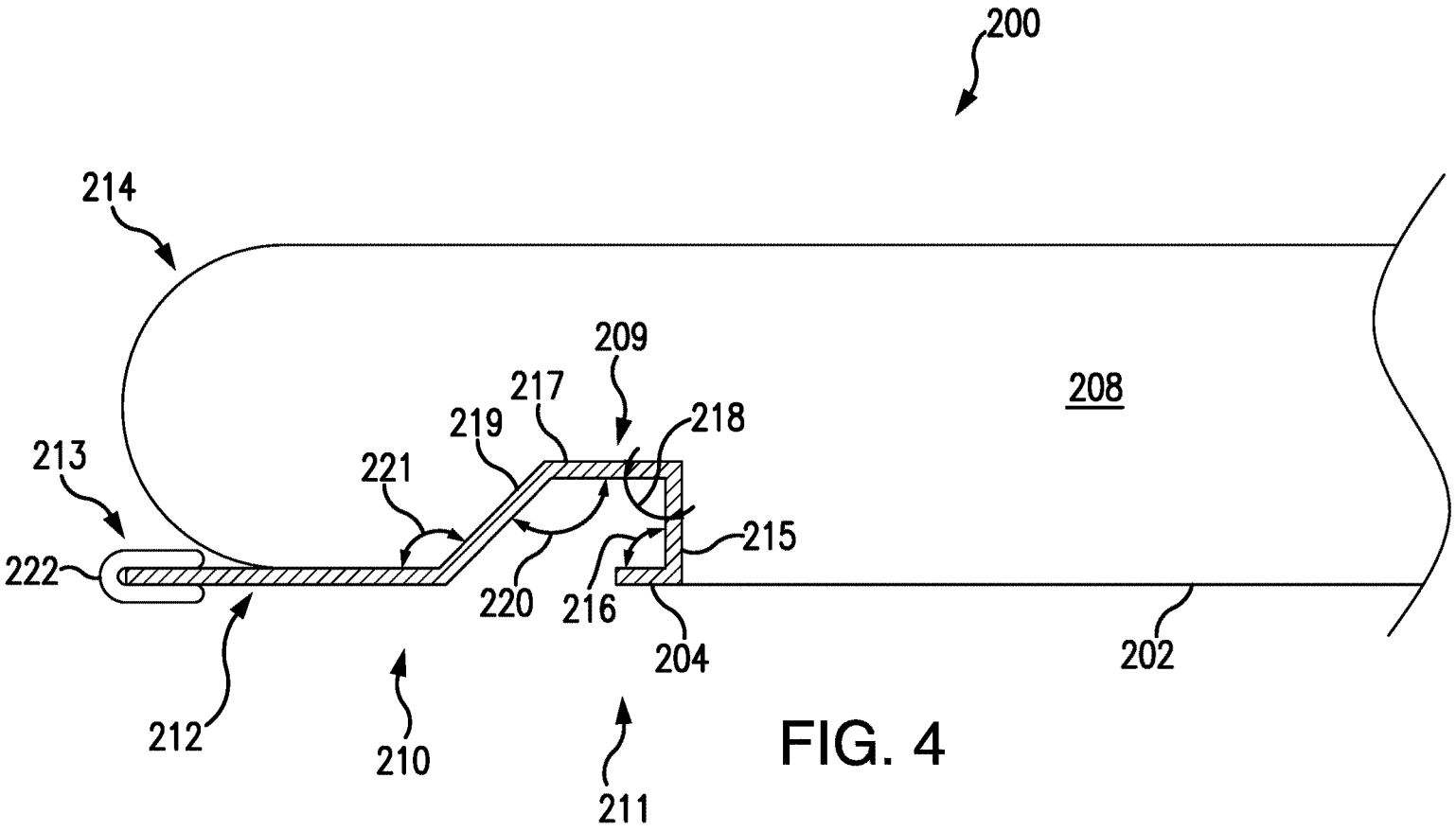
FIG. 4 is a perspective detail view of the handle portion of one embodiment of the present invention.

Referring to FIGS. 2-4, one embodiment of the present invention 200 comprises a paint brush 201 having a brush head 207 and a handle 208. Proximate to the distal end of the handle 208, there is a recessed tool channel 209 in one lateral edge 202 of the handle 208.

Fixedly set into the tool channel, by screws, adhesives or other permanent attachment means, is a tool 210 comprising a narrow strip of rigid metal, such as steal. The tool 210 comprises a proximal flanged segment 211 and a distal, flat lever segment 212, which extends longitudinally within the tool channel 209 along the lateral edge 202 of the handle 208 and emerges as a free lever end 213 at the tapered distal end of the handle 214.

The flanged segment 211 of the tool 210 comprises a flange member 204, extending distally, in line with the lateral edge 202 of the brush handle 208, from a transverse strip 215 recessed within the proximal end of the tool channel 209. The flange member 204 extends at a right or obtuse flange angle 216 from the transverse strip 215. Preferably, the flange angle 216 is in the range of 90° to 120°.

The transverse strip 215 transitions distally into a notch strip 217, with which it forms a right or obtuse notch angle 218, preferably in the range of 90° to 120°. The notch strip 217 transitions distally into a ramp strip 219, with which it forms an obtuse ramp angle 220, preferably in the range of 120° to 150°. The ramp strip 219 transitions distally into the lever segment 212 of the tool 210, with which it forms an obtuse lever angle 221, preferably in the range of 120° to 150°.

The length of the ramp strip 219 is greater than the length of the transverse strip 215, which is greater than the length of the flange member 204. Preferably, the length of the notch strip 217 is less than that of the ramp strip 219, but greater than that of the transverse strip 215.

Optionally, a smooth plastic sheath 222 can be provided to cover the free lever end 213 when the tool is not in use, so as to protect the hand of a painter from being scratched or cut. Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A device for prying open and re-sealing a lid of a paint can, the device comprising:

a paint brush having a brush head and a brush handle, wherein the brush handle has two lateral edges, and wherein the brush handle has a proximal end, which is proximate to the brush head, and a distal end;

a recessed tool channel located proximate to the distal end of the brush handle in a first lateral edge of the brush handle, wherein the tool channel has a channel width, a proximal end and a distal end;

a tool, comprising a rigid metal strip having a width slightly less than the channel width, wherein the tool comprises a proximal flanged segment and a distal, flat lever segment, and wherein the flanged segment of the tool is fixedly recessed flush inside the tool channel in the first lateral edge of the brush handle, and wherein the lever segment of the tool fixedly extends flatly and longitudinally substantially along the first lateral edge of the brush handle from the distal end of the tool channel to the distal end of the brush handle;

wherein the flanged segment of the tool comprises a flange member, which extends distally, substantially in line with the first lateral edge of the brush handle, at a right or obtuse flange angle from a transverse strip recessed within the proximal end of the tool channel, and wherein the transverse strip transitions distally at a right or obtuse notch angle into a notch strip, and wherein the notch strip transitions distally at an obtuse ramp angle into a ramp strip, and wherein the ramp strip transitions distally at an obtuse lever angle into the lever segment of the tool, and wherein a length of the transverse strip is greater than a length of the flange member, and wherein a length of the ramp strip is greater than the length of the transverse strip; and wherein the lever segment of the tool comprises a proximal side and a distal side, and wherein the proximal side of the lever segment fixedly engages the first lateral edge of the brush handle and the distal end of the tool channel, and wherein the distal side of the lever segment has a free lever end, which does not engage either the brush handle or the tool channel.

2. The device according to claim 1, wherein a length of the notch strip is less than the length of the ramp strip, and wherein the length of the notch strip is greater than the length of the transverse strip.

3. The device according to claim 2, wherein the flange angle is in the range of 90° to 120°, and wherein the notch angle is in the range of 90° to 120°, and wherein the ramp angle is in the range of 120° to 150°, and wherein the lever angle is in the range of 120° to 150°.

4. The device according to claim 2, further comprising a smooth plastic sheath which removably encases the free lever end of the lever segment of the tool when the tool is not in use.

5. The device according to claim 4, wherein the flange angle is in the range of 90° to 120°, and wherein the notch angle is in the range of 90° to 120°, and wherein the ramp angle is in the range of 120° to 150°, and wherein the lever angle is in the range of 120° to 150°.

6. The device according to claim 1, further comprising a smooth plastic sheath which removably encases the free lever end of the lever segment of the tool when the tool is not in use.

7. The device according to claim 3, wherein the flange angle is in the range of 90° to 120°, and wherein the notch angle is in the range of 90° to 120°, and wherein the ramp angle is in the range of 120° to 150°, and wherein the lever angle is in the range of 120° to 150°.

8. The device according to claim 1, wherein the flange angle is in the range of 90° to 120°, and wherein the notch angle is in the range of 90° to 120°, and wherein the ramp angle is in the range of 120° to 150°, and wherein the lever angle is in the range of 120° to 150°.

* * * * *